United States Patent [19]

Shim

[11] Patent Number: 4,483,777

[45] Date of Patent: Nov. 20, 1984

[54] STABILITY IMPROVERS FOR WATER-IN-OIL EMULSION

[75] Inventor: Joosup Shim, Wenonah, N.J.

[73] Assignee: Mobil Oil Corporation, New York, N.Y.

[21] Appl. No.: 419,877

[22] Filed: Sep. 20, 1982

[51] Int. Cl.[3] ..... C10M 1/06

[52] U.S. Cl. ..... 252/49.5; 252/32.7 E; 252/51.5 R

[58] Field of Search ..... 252/49.5

[56] References Cited

U.S. PATENT DOCUMENTS

| | | | |
|---|---|---|---|
| 3,089,854 | 5/1963 | Meyers et al. | 252/49.5 |
| 3,280,029 | 10/1966 | Waldmann | 252/49.5 |
| 3,298,954 | 1/1967 | Brown | 252/49.5 X |
| 3,629,119 | 12/1971 | Weaver | 252/49.5 X |
| 4,289,546 | 9/1981 | Hacias | 252/49.5 X |

*Primary Examiner*—Andrew Metz

*Attorney, Agent, or Firm*—Alexander J. McKillop; Michael G. Gilman; Howard M. Flournoy

[57] ABSTRACT

Fire resistant hydraulic fluids comprising water in oil emulsions are stabilized with water soluble aminohydroxy compounds to provide superior high temperature emulsion stability.

1 Claim, No Drawings

STABILITY IMPROVERS FOR WATER-IN-OIL EMULSION

BACKGROUND OF THE INVENTION

1. Field of the Invention

This invention relates to emulsifiable lubricants, and particularly for those for use in water-in-oil emulsions containing water soluble aminohydroxy compounds.

2. Description of the Prior Art

The use of water-in-oil emulsion fluids as lubricants in industrial applications, for example, as hydraulic fluids and in other areas where lubricants are necessary, is well known to those skilled in the part. An essential component of water-in-oil emulsion lubricants, particularly when these lubricants are employed as hydraulic fluids in the present of oil as a continuous phase with water dispersed therein. Water comprising from about 10 to less than about 69 percent by weight of the total emulsion fluid. It has now been discovered that water soluble aminohydroxy compounds provide outstanding high temperature emulsion stability performance for water and oil emulsion useful as fire resistant hydraulic oils.

SUMMARY OF THE INVENTION

In accordance with the invention, there is provided a emulsifiable lubricant composition comprising a major amount of a lubricant, a lesser amount of water, a minor amount of a conventional emulsifier stabilizer package, or an effective amount of a co-emulsifier or a coupling agent selected from suitable water soluble aminohydroxy compounds having the general formula

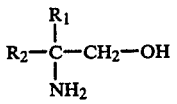

or a heterocyclic amine having the general formula

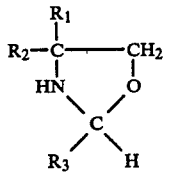

or mixtures thereof wherein $R_1$, $R_2$ and $R_3$ are alike or dissimilar $C_1$ to $C_4$ alkyl groups.

DISCUSSION OF SPECIFIC EMBODIMENTS

The emulsifier lubricant may contain from about 0.2 to about 10 percent by weight of the aminohydroxy compound or heterocyclic amine, preferably from about 0.3 to about 3 percent by weight, the remainder being lubricant or lubricant and other additives. The lubricant itself broadly comprises from about 40 percent by weight to about 80 percent by weight of the emulsified composition, preferably from about 50 percent to about 70 percent. The remainder of the emulsion comprises water and usually other additives for their known purpose. The water content may range from about 10 percent to less than about 50 percent by weight.

We have found that a number of water soluble aminohydroxy compounds are effective stability improvers. Co-emulsifiers or coupling agents act to improve the emulsion stability of water-in-oil base emulsion oils which contain other functional additives.

The stability effect of these additives is synergistic with prior art emulsifiers in the base emulsion. The co-emulsifier system is thus superior to any of these additives when used alone. A key performance requisite of water-in-oil emulsion fire-resistance hydraulic oils is high temperature emulsion stability. Although none of these additives alone would form a suitable base emulsion, their synergistic effect with prior art emulsifiers in the base composition permits the resultant emulsion to meet the key performance requisite of high temperature emulsion stability.

Aminohydroxy compounds suitable for use in the invention as embodied herein include, but are not limited to the following: isopropylaminoethanol, triethanolamine, 2-amino-2-methyl-1-propanol, and polyethoxylated soyamine a representative heterocyclic compound is oxazolidine, 2-amino-ethanol, di-ethanolamine, isopropanol di-ethanolamine, ethyl di-ethanolamine, di-isopropylaminoethanol and 2-di-ethylaminoethanol.

The lubricant oils employed in the composition of the present invention may comprise mineral oils, sythetic oils, especially synthetic hydrocarbon oils or a combination of mineral oils with synthetic oils of lubricating viscosity when particularly high temperature stability is not a requirement, mineral oils having a viscosity of at least 40 SUS at 100° F. and particularly those following within the range from about 60 SUS to about 600 SUS at 100° F. may be employed. When sythetic lubricants are employed, either alone or in addition to mineral oils, various compounds of this type may be utilized. Typical synthetic oils include polypropylene glycol, trimethylolpropane esters, neopentyl and pentaerythritol esters, di-(2-ethyl hexyl)sebacate, di-2(-ethyl hexyl)adipate, dibutyl phthalate, fluorocarbons, silicate esters, silanes, esters of phosphorus-containing acids, liquid ureas, ferrocene derivatives, hydrogenated mineral oils, chain-type polyphenols, siloxanes and silicones (polysiloxanes), alkyl-substituted diphenyl ethers typified by a butyl-substituted bis-(p-phenoxy phenyl)ether, phenoxy phenyl ethers, and the like.

EVALUATION OF THE PRODUCT (WATER-IN-OIL EMULSION STABILITY TEST)

Oven Stability Test

Heat 100 ml of the water-in-oil emulsion in a stoppered 100 ml graduated cylinder at 200° F.±1° F. in an oven with forced ventilation. Record free water and free oil every 24 hours. When either free water reaches 10 percent by volume or free oil reaches 15 percent by volume, terminate the test, as the emulsion is judged no longer stable.

Example 1 is a water-in-oil emulsion base fluid in accordance with the present invention. The stability effect of specific additives in this water-in-oil emulsion hydraulic oil is demonstrated with nine examples ranging from ethylene glycol (Example 2), and water soluble alkyl alkanol amines, alcohol, amine salts and aminohydroxy compounds (Examples 3–9). The stability results are recorded and summarized in Table 2. The motion stability was determined via conventional methods using the aforementioned 200° F. Oven Stability Test.

EXAMPLE 1

TABLE 1

COMPOSITION OF W/O EMULSION BASE FLUID

| CHEMICAL TYPE | FUNCTION | % WT. |
|---|---|---|
| Solvent Paraffinic Neutral | Lubricant | 51.40 |
| Water | Fire-retardant | 41.00 |
| A mixture of sulfonates, amines and zinc dithiophosphate | Emulsifier/ Stabilizer/ Antiwear package | 7.60 |

These data clearly establish that the compounds embodied in this invention function extremely well as coemulsifiers.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

TABLE 2

EMULSION STABILITY OF W/O EMULSION HYDRAULIC FLUIDS

| | Example 1 | Example 2 | Example 3 | Example 4 | Example 5 | Example 6 | Example 7 | Example 8 | Example 9 |
|---|---|---|---|---|---|---|---|---|---|
| W/O Emulsion Base Fluid | 100.0 | 98.0 | 99.70 | 99.70 | 99.70 | 99.70 | 99.70 | 99.70 | 99.70 |
| Ethylene Glycol | | 2.0 | | | | | | | |
| Isopropyl aminoethanols | | | .03 | | | | | | |
| Triethanol amine | | | | 0.3 | | | | | |
| Amine salts of organic acids | | | | | 0.3 | | | | |
| Alkylaryl polyether alcohol | | | | | | 0.3 | | | |
| Polyethoxylated soyamine | | | | | | | 0.3 | | |
| 2-amino-2-methyl-1-propanol | | | | | | | | 0.3 | |
| Oxazolidine | | | | | | | | | 0.3 |
| Emulsion stability at 200° F. Days to separation | 4 | 4 | 34 | 18 | 1 | 1 | 4 | 30+ | 30+ |

I claim:

1. In a fire-resistant, water-in-oil emulsion comprising about 40 to about 80% by weight of an oil of lubricating viscosity, from about 10 to less than about 50% by weight of water and a minor emulsifying amount of an emulsifier/stabilizer package, the improvement comprising a water-in-oil emulsion further containing a minor emulsifying amount of a coemulsifier, polyethoxylated soya amine.

* * * * *